US009919848B2

(12) United States Patent
Benigni et al.

(10) Patent No.: US 9,919,848 B2
(45) Date of Patent: Mar. 20, 2018

(54) METHOD FOR ASSEMBLING A PACKAGING DEVICE

(71) Applicant: QUALIPAC, Neuilly sur Seine (FR)

(72) Inventors: Christophe Benigni, Pantin (FR); Thierry Nizou, Cergy Pontoise (FR)

(73) Assignee: Qualipac, Clichy (FR)

( * ) Notice: Subject to any disclaimer, the term of this patent is extended or adjusted under 35 U.S.C. 154(b) by 19 days.

(21) Appl. No.: 14/433,497

(22) PCT Filed: Oct. 7, 2013

(86) PCT No.: PCT/FR2013/052375

§ 371 (c)(1),
(2) Date: Apr. 3, 2015

(87) PCT Pub. No.: WO2014/053793

PCT Pub. Date: Apr. 10, 2014

(65) Prior Publication Data

US 2015/0246758 A1 Sep. 3, 2015

(30) Foreign Application Priority Data

Oct. 5, 2012 (FR) ..... 12 59486

(51) Int. Cl.
*B65D 41/16* (2006.01)
*B65D 45/02* (2006.01)
(Continued)

(52) U.S. Cl.
CPC ..... *B65D 45/02* (2013.01); *B65B 7/285* (2013.01); *B65D 13/02* (2013.01); *B65D 45/322* (2013.01);
(Continued)

(58) Field of Classification Search
CPC ..... B65D 2543/00564; B65D 2543/00972; B65D 45/02; B65D 2543/00537; B65D 2543/00555
(Continued)

(56) References Cited

U.S. PATENT DOCUMENTS 1,647,175 A 11/1927 Grunberg
2,063,185 A * 12/1936 Nave ..... B65D 43/022 215/364
(Continued)

FOREIGN PATENT DOCUMENTS

DE 9316254 U1 2/1994
DE 20 2010 014394 U1 2/2011
(Continued)

OTHER PUBLICATIONS

French Search Report Application No. PCT/FR2013/052375; dated Dec. 2, 2013.

*Primary Examiner* — Shawn M Braden
(74) *Attorney, Agent, or Firm* — Miller, Matthias & Hull LLP

(57) ABSTRACT

The invention relates to a method for assembling a device for packaging a cosmetic product, said device comprising: a glass container, said container having an opening, one edge of said opening forming a bead; a closure piece having a base with a shape substantially complementary to that of the opening in the container; a locking piece; the closure piece is mounted on the glass container by elastic fitting of the side walls around the bead, by moving the bead in translation towards the base of the closure piece, said elastic fitting ensuring sealed contact between the closure piece and the edge of the container; the locking piece is force-fitted around the side walls of the closure piece.

23 Claims, 8 Drawing Sheets

(51) Int. Cl.

| | |
|---|---|
| ***B65D 45/32*** | (2006.01) |
| ***B65D 53/02*** | (2006.01) |
| ***B65B 7/28*** | (2006.01) |
| ***B65D 13/02*** | (2006.01) |

(52) U.S. Cl.
CPC ..... *B65D 53/02* (2013.01); *B65D 2251/0018* (2013.01); *B65D 2251/0081* (2013.01)

(58) Field of Classification Search
USPC ..... 220/795
See application file for complete search history.

(56) References Cited

U.S. PATENT DOCUMENTS

| | | | | |
|---|---|---|---|---|
| 3,195,995 | A | 7/1965 | Rowe | |
| 3,223,278 | A | 12/1965 | Allen | |
| 3,567,060 | A * | 3/1971 | Ballin | A61J 9/008 215/11.6 |
| 3,741,423 | A * | 6/1973 | Acton | B65D 41/0457 215/318 |
| 3,844,439 | A | 10/1974 | Demers et al. | |
| 3,913,771 | A | 10/1975 | Acton et al. | |
| 3,930,589 | A | 1/1976 | Koontz | |
| 4,066,181 | A | 1/1978 | Robinson et al. | |
| 4,072,491 | A | 2/1978 | Kramer et al. | |
| 4,196,899 | A | 4/1980 | Patterson | |
| 4,423,822 | A | 1/1984 | Powalowski | |
| 4,629,084 | A * | 12/1986 | Hackelsberger | B65D 45/18 206/508 |
| 4,771,903 | A | 9/1988 | Levene | |
| 4,773,553 | A | 9/1988 | Van Brocklin | |
| 5,012,970 | A * | 5/1991 | Kucherer | B05B 11/0037 220/289 |
| 5,123,571 | A * | 6/1992 | Rebeyrolle | B65D 83/62 220/23.83 |
| 5,235,853 | A * | 8/1993 | Froes | B44B 5/026 116/201 |
| 5,443,853 | A | 8/1995 | Hayes | |
| 5,720,552 | A | 2/1998 | Schindlegger | |
| 6,158,604 | A | 12/2000 | Larguia | |
| 6,362,461 | B1 | 3/2002 | Lfelder Kunststoffw | |
| 6,398,050 | B1 | 6/2002 | Allora | |
| 7,114,617 | B2 * | 10/2006 | Yewdall | A61F 15/001 206/440 |
| 7,134,565 | B1 | 11/2006 | Miles et al. | |
| 8,251,245 | B2 * | 8/2012 | DiPietro | B65D 43/0212 220/255 |
| 9,132,946 | B2 * | 9/2015 | Sze | B65D 43/022 |
| 2005/0006390 | A1 | 1/2005 | Wang | |
| 2006/0091099 | A1 | 5/2006 | Klepac | |
| 2008/0023491 | A1 * | 1/2008 | Rousselet | A45D 40/0068 222/256 |
| 2013/0134123 | A1 * | 5/2013 | Fraser | B65D 41/0442 215/328 |

FOREIGN PATENT DOCUMENTS

| | | | |
|---|---|---|---|
| EP | 0309001 | A2 | 3/1989 |
| EP | 0653359 | A1 | 5/1995 |
| EP | 0825122 | A2 | 2/1998 |
| EP | 1289858 | A1 | 3/2003 |
| FR | 417244 | A | 11/1910 |
| FR | 483945 | A | 8/1917 |
| FR | 877132 | A | 11/1942 |
| FR | 2 387 853 | A1 | 11/1978 |
| FR | 2 632 931 | A1 | 12/1989 |
| FR | 2 747 646 | A1 | 10/1997 |
| FR | 2 852 580 | A1 | 9/2004 |
| GB | 943182 | A | 12/1963 |
| GB | 1441771 | A | 7/1976 |
| JP | 2003095671 | A | 4/2003 |
| WO | WO 8802297 | A1 | 4/1988 |
| WO | WO 0192132 | A1 | 12/2001 |
| WO | WO 03068622 | A1 | 8/2003 |
| WO | WO 2012056154 | A2 | 5/2012 |

* cited by examiner

METHOD FOR ASSEMBLING A PACKAGING DEVICE

CROSS-REFERENCE TO RELATED APPLICATION

This Application is a 35 USC § 371 US National Stage filing of International Application No. PCT/FR2013/052375 filed on Oct. 7, 2013, and claims priority under the Paris Convention to French Patent Application No. 12 59486 filed on Oct. 5, 2012.

FIELD OF THE DISCLOSURE

The present invention relates to a method for assembling a packaging device comprising a glass container, intended in particular for receiving a cosmetic product.

BACKGROUND OF THE DISCLOSURE

In the field of packaging, it is conventional to create a glass container by blowing. This creates a container having a tubular neck of narrow dimensions, which can be sealed closed by any suitable means. As the dimensional accuracy of such a blowing process is fairly low, the sealing solution must be overdesigned. The small size of the opening facilitates establishing the seal, which makes it easy to overdesign the sealing solution to ensure a sufficiently tight result for the desired application. An example can be found in U.S. Pat. No. 6,158,604. However, glass blowing is a technique where only the external form of the container can be controlled. It is therefore common for a glass container created by a blowing process to have an irregular internal shape, particularly when blowing to give the container a polygonal external shape.

However, there is increasing demand for control of the internal shape of glass containers, particularly in the cosmetics or spirits industries where packaging aesthetics play a particularly important role.

An alternative technique exists for producing a glass container, which allows controlling both the external shape and internal shape. This alternative technique is the pressing of glass. However, creating a pressed-glass container does not allow the container to have a tubular neck of narrow dimensions the way it can when the container is blown glass. A pressed-glass container therefore conventionally defines an opening of large dimensions, of about the size of a shaping plunger.

It is known from the prior art to close the pressed-glass container by means of a threaded lid with a disc-shaped gasket to seal the packaging device. However, such a solution is limited to containers comprising a circular opening.

It is also known from the prior art to close a plastic container with a snap-fitting lid. U.S. Pat. No. 3,223,278 provides an example of such an implementation. However, glass does not allow as precise a control of manufacturing tolerances as plastic. It would therefore be difficult to transpose such a solution for sealing the packaging device to a glass container.

SUMMARY OF THE DISCLOSURE

The present invention provides an alternative solution adapted for packaging devices comprising a pressed-glass container of any shape.

More specifically, an object of the present invention is a method for assembling a device for packaging a cosmetic product, said device comprising:

- a container of pressed glass, said container having an opening, an edge of said opening forming a bead;
- a closure piece having at least one side wall made of an elastically deformable material, said at least one side wall being provided with an internal relief, said relief forming a means of assembly by elastically interlocking around the bead

- a locking piece, adapted to be fitted around said at least one side wall of the closure piece, said locking piece comprising at least one side wall made of a material that allows little elastic deformation;

the closure piece or the glass container having an opening providing access to the product of the packaging device, the method comprising the following steps:

- the closure piece is mounted on the glass container by elastically interlocking the at least one side wall of the closure piece around the bead by moving the container relative to the closure piece in a direction of assembly, said elastic interlocking ensuring a sealing contact between the closure piece and the container;
- the locking piece is fitted around said at least one side wall of the closure piece.

Such an assembly method has the advantage of being suitable for a glass container produced by pressing, and of not limiting the shape of said container to a tubular shape, particularly not limiting the shape of its opening to a right-circular geometry.

According to one embodiment, the closure piece further comprises a compressible or deformable gasket applied against the base of the closure piece prior to assembly of the closure piece and glass container, the elastic interlocking of said at least one side wall of the closure piece around the bead ensuring a sealing contact between the gasket and the edge of the container on the one hand, and between the gasket and the closure piece on the other. According to one embodiment, the locking piece is force-fitted in the direction of assembly.

According to one embodiment, the edge comprises an annular body from which the bead projects, the annular body having an inner surface and an outer surface parallel to the inner surface, one and/or the other of these surfaces having a non-circular cross-section transversely to the direction of assembly. Indeed, the method enables a sealed assembly in particular for non-right-circular geometries.

According to one embodiment, the inner surface of the annular body allows the passage of a rigid volume corresponding to a homothetic transformation at a ratio of between 75% and 120% of the volume defined by the inner surface of the main body. In other words, the container has a large opening.

According to some embodiments, the method further comprises one or more of the following characteristics:

- the internal relief is continuous along the entire periphery of the at least one side wall,
- the locking piece is fitted around said at least one side wall of the closure piece by force-fitting the locking piece around said at least one side wall of the closure piece,
- the locking piece is fitted around the side walls of the closure piece by force-fitting the locking piece around the side walls of the closure piece,
- the closure piece has a base of a shape substantially complementary to that of the opening of the container;

the closure piece has a base and the closure piece is mounted on the glass container by moving the bead in translation towards the base of the closure piece;

the closure piece comprises at least one side wall having a free edge that is continuous;

the closure piece comprises side walls having a free edge that is continuous, the side walls being provided with the internal relief, and the internal relief is continuous along the entire periphery of the side walls, the locking piece being force-fitted around the side walls of the closure piece;

the closure piece comprises side walls of which a free edge is continuous, the side walls being provided with the internal relief, the internal relief is continuous along the entire periphery of the side walls, the closure piece is mounted on the glass container by elastically interlocking the side walls around the bead, and in addition said elastic interlocking ensures a sealing contact between the closure piece and the edge of the container;

the locking piece is made of a material that allows little elastic deformation.

The invention also relates to a packaging device for a cosmetic product, comprising a container of pressed glass, said container having an opening, an edge of said opening forming a bead;

a closure piece having at least one side wall made of an elastically deformable material, said at least one side wall being provided with an internal relief, said relief forming a means of assembly by elastically interlocking around the bead, said elastic interlocking ensuring a sealing contact between the closure piece and the container;

a locking piece, fitted around said at least one side wall of the closure piece, said locking piece having at least one side wall made of a material that allows little elastic deformation;

the closure piece or the glass container having an opening providing access to the product of the packaging device.

According to one embodiment, the edge comprises an annular body from which the bead projects, the annular body having an inner surface and an outer surface parallel to the inner surface, one and/or the other of these surfaces having a non-circular cross-section transversely to the direction of assembly.

According to one embodiment, the inner surface of the annular body allows the passage of a rigid volume corresponding to a homothetic transformation at a ratio of between 75% and 120% of the volume defined by the inner surface of the main body.

According to one embodiment, the closure piece is adapted to form a sealing connection with at least two surfaces of the container edge, these surfaces being selected from among an inner side surface, an upper surface, and the bead.

According to one embodiment, the closure piece has a face suitable for being compressed against a corner of the container edge, said corner being formed between an upper surface and an inner side surface or the bead.

According to one embodiment, the closure piece comprises at least one protruding element suitable for forming a sealing line against the container edge.

According to one embodiment, the closure piece comprises a compressible gasket suitable for forming a sealing connection between the container edge and the closure piece.

According to one embodiment, the gasket is suitable for forming a sealing connection between the closure piece and at least two surfaces of the edge of the container, these surfaces being selected from among an inner side surface, an upper surface, and the bead.

According to one embodiment, the gasket has a face suitable for being compressed against a corner of the container edge, formed between an upper surface and an inner side surface or the bead.

According to one embodiment, the gasket comprises at least one protruding element suitable for forming a sealing line against the container edge.

According to one embodiment, the bead is continuous along the entire periphery of the edge.

According to one embodiment, the opening has a cylindrical shape which is not of right-circular geometry.

According to one embodiment, the closure piece comprises the opening providing access to the product.

According to one embodiment, the locking piece comprises an opening communicating with the opening providing access to the product of the closure piece.

According to one embodiment, the container comprises the opening providing access to the product.

According to one embodiment, the locking piece comprises a free edge in intimate contact with the container.

According to one embodiment, the locking piece is permanently assembled to the container.

According to some embodiments, the device further comprises one or more of the following characteristics:

the internal relief is continuous along the entire periphery of the at least one side wall, the locking piece is force-fitted around said at least one side wall of the closure piece, the closure piece has a base of a shape substantially complementary to that of the opening of the container;

the closure piece has a base and the closure piece is mounted on the glass container by moving the bead in translation towards the base of the closure piece;

the closure piece comprises at least one side wall having a free edge that is continuous;

the closure piece comprises side walls of which a free edge is continuous, the side walls being provided with the internal relief, and the internal relief is continuous along the entire periphery of the side walls, the locking piece being force-fitted around the side walls of the closure piece;

the closure piece comprises side walls of which a free edge is continuous, the side walls being provided with the internal relief, the internal relief is continuous along the entire periphery of the side walls, the closure piece is mounted on the glass container by elastically interlocking the side walls around the bead, and in addition said elastic interlocking ensures a sealing contact between the closure piece and the edge of the container;

the locking piece is made of a material that allows little elastic deformation.

The embodiments described above may advantageously be combined.

BRIEF DESCRIPTION OF THE DRAWINGS

The invention will be better understood by reading the following description and examining the accompanying figures. These are illustrative only and are not limiting of the invention. The figures show.

DETAILED DESCRIPTION OF THE DISCLOSURE

Figure 1:
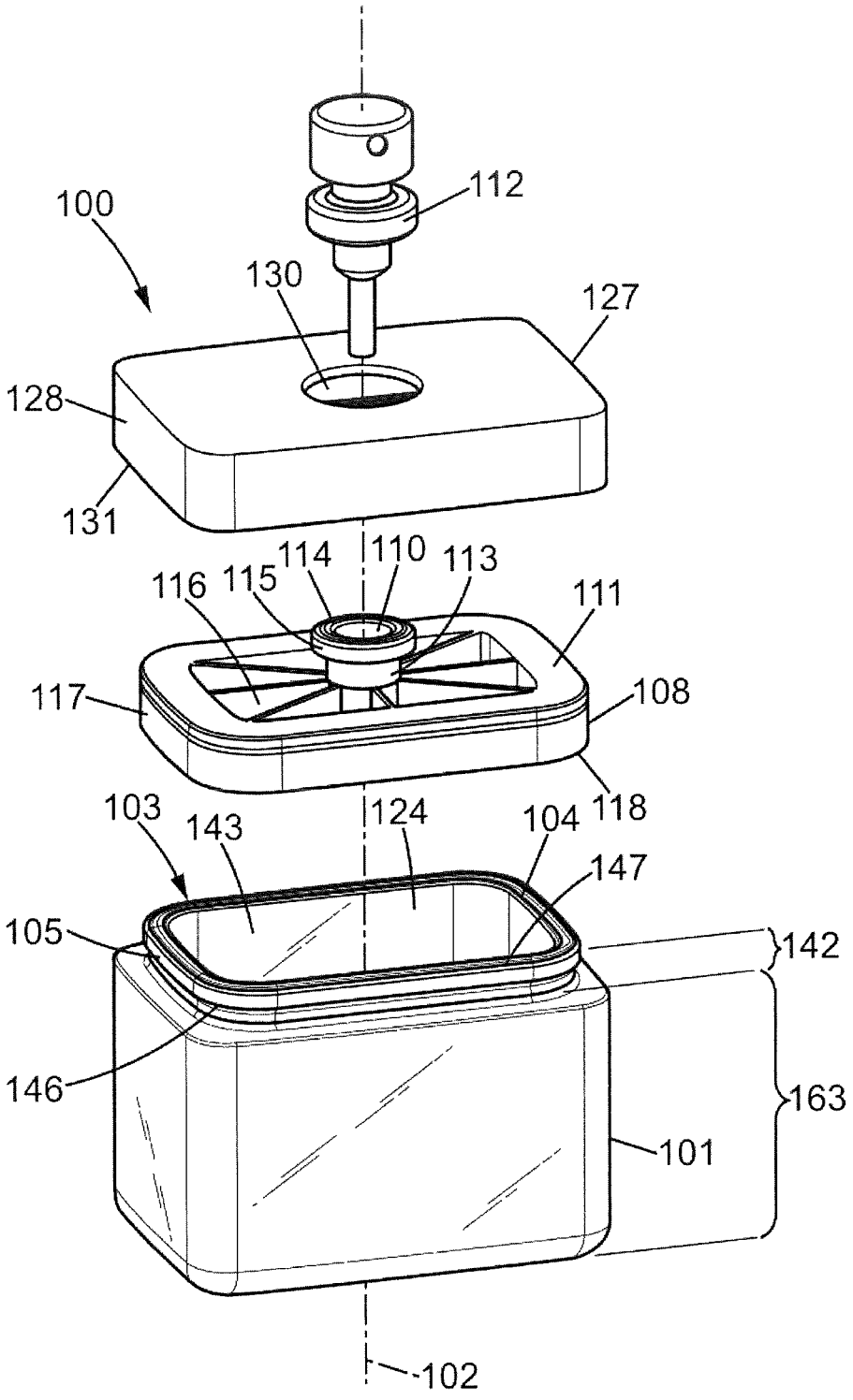
FIG. 1: an exploded perspective view of a packaging device for a cosmetic product according to one embodiment of the invention.

FIG. 1 shows an exploded perspective view of a packaging device 100 for cosmetics or spirits according to one embodiment of the invention.

The packaging device 100 comprises a glass container 101. The glass container 101 is, for example, made by a pressing process.

Figure 13:
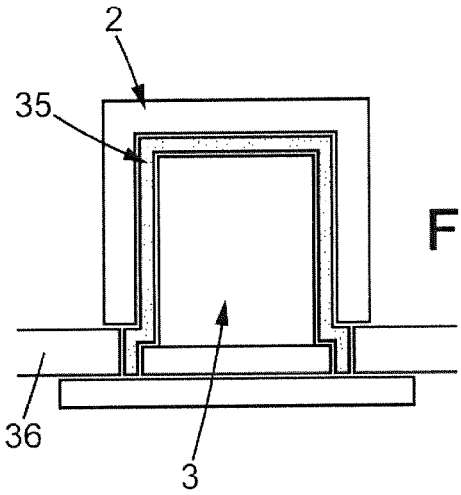
FIG. 13: a schematic view of a pressing process.

As can be seen in FIG. 13, a highly schematic representation, a body mould 2, an opening mould 36, and a plunger 3 are used together to form a cavity for receiving a glass gob 35. The plunger 3 is movable, relative to moulds 2 and 36, between a withdrawn position and an extended position where the cavity gives the future shape to the container 101. As is known, the container 101 therefore has a wide opening to allow the passage of the plunger. The plunger 3 defines the internal shape of the container 101, and the moulds its external shape. The opening mould 36 can be used to shape an assembly interface of the bottle, this assembly interface being used for closing the bottle.

Where appropriate, the pressing step described below is followed by a blowing step, in which the main body 163 is deformed by blowing into its inside volume. This blowing step can increase the inside volume of the bottle by about 10% to 20%, if one wants to maintain the geometrical properties of the inside surface that were obtained during the pressing step. The term "pressed" as used here refers to any implementation that includes a pressing step, including cases where it is followed by a blowing step.

In the example, the container 101 has the shape of a rectangular cylinder of axis 102 and having a substantially rectangular cross-section. When describing the shape of the container 101, we are primarily interested in the shape of its main body 163. The container 101 has a main body 163 providing most of its volume, and an integral assembly interface 142 which will be described in detail below. In other words, the container 101 has a hollow shape suitable for holding a liquid or paste. The container 101 comprises a base 133 from which extends a peripheral wall 134. Thus, when the container 101 is said to have the shape of a cylinder, it is understood that the peripheral wall 134 has a generally cylindrical shape. The container 101 comprises an inner face 135, intended to be in contact with the contents of the container 101, and an outer face 136 opposite the inner face. The base 133 and the peripheral wall 134 thus each have an inner face, respectively 137 and 138, together forming a portion of the inner face 135 of the container. The base 133 and the peripheral wall 134 thus each have an outer face, respectively 139 and 140, together forming a portion of the outer face 136 of the container. In the example represented, the outer face 139 of the base 133 defines the support surface 141 of the packaging device 100. In other words, when stored normally the packaging device 100 remains balanced and stable when placed with its support surface 141 resting on a horizontal surface of a support such as a piece of furniture. The peripheral wall 134 extends transversely to the support surface 141. In the example shown, it extends orthogonally to the support surface 141. Thus, when the container 101 is said to have the shape of a cylinder, this is primarily referring to the general shape of the outer face 140 of the peripheral wall 134, between the base and the assembly interface. One will recall that cylinder is understood to mean a form generated by the sweep of a line parallel to a generating direction in a closed profile of any shape. In the present example, the generating direction is normal to the support surface 141. In this case, the closed profile has a substantially rectangular geometry. Substantially rectangular is understood here to include a closed profile having the shape of a rectangle with rounded corners.

However, it is possible to adapt other shapes to the container 101, such as polygonal, spheroid, or any other shape.

For the shapes referred to above, it is understood that:

For polygonal shapes, the polygonal shape is presented herein with reference to the above substantially rectangular cross-section. This means that the closed profile mentioned above is a polygon with at least three sides, typically a triangle, a quadrilateral such as a diamond, a trapezoid, a square, a rectangle, a parallelepiped, or some other polygon of five or more sides. The polygon can be either regular (once or more symmetrical sides of equal length, . . . ) or irregular. In addition, as above for the rectangle, it may have a substantially polygonal shape, for example a polygon with rounded corners.

Figure 3A:
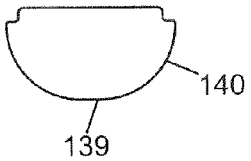
FIGS. 3*a* and 3*b*: schematic views, respectively from the side and from above, of the external shape of a container according to one embodiment.
Figure 3B:
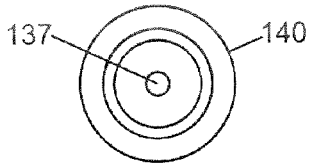
Figure 4A:
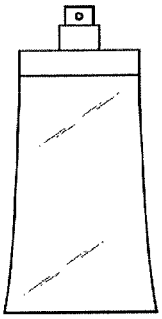
FIGS. 4*a*, 4*b*, 4*c*, 4*d*; views similar to FIG. 3*a* for other embodiments.
Figure 4B:
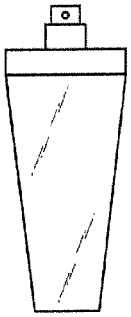
Figure 4C:
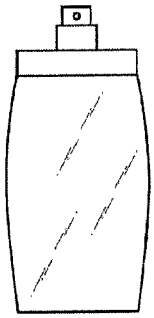
Figure 4D:
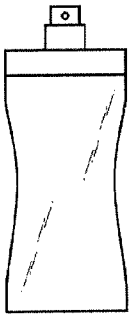

For spheroid shapes, it is of course understood that this expression is not as opposed to "rectangular" but to "cylindrical". Thus, according to this embodiment, the main body 163 of the container 101 generally has the external shape of a truncated half sphere, as shown in FIGS. 3*a* and 3*b*. The peripheral wall 134 thus has an outer face 140 in the form of a sphere portion. The outer face 139 of the base 133 may be flat to serve as the support surface 141. The term "spheroid" refers to a geometry similar to that of a sphere portion.

As has already been seen for two different embodiments, the external shape of the main body 163 of the container 101 can vary widely, including a cylindrical shape with a substantially rectangular or polygonal profile, or a spheroid shape. The expression "any shape" of the container 101 is understood to mean that it is not limited to these embodiments and that others can be provided as long as they are compatible with the structure of the device, as conceived by a person skilled in the art. Possible variants are, for example, implemented from a cylindrical shape having a cross-section perpendicular to the axis of the generating line that is not necessarily constant but may vary, for example homothetically, for example forming a converging or diverging cone, or an inward or outward bulge, as respectively illustrated in FIGS. 4*a*, 4*b*, 4*c*, and 4*d*.

Note that in the above description the shape primarily relates to the external shape of the container 101. The internal shape of the container 101 can be independent of its external shape, as long as the container can be made (particularly by a pressing process) and used in the desired configurations (requiring for example a minimum glass thickness for the desired application).

The container 101 has an opening 103 arranged along axis 102. Here the opening 103 is opposite the base 133. In the example shown, the opening 103 is planar and substantially rectangular in shape. However, the opening 103 may be of any polygonal shape, or oval or circular in shape.

The opening 103 of the container 101 has an edge 104 forming a bead 105. The bead 105 is arranged substantially perpendicularly to axis 102. The bead 105 of the container 101 is particularly visible in FIG. 2, FIG. 2*a*, and FIG. 2*b*.

It is therefore understood that the term "opening" 103 is not used here to indicate, according to the most common usage, an empty space providing access, but rather refers to an assembly interface 142 of the container 101 comprising an edge 104 surrounding this access space 143.

As can be seen in FIG. 1, the invention is particularly suitable for large openings. Intrinsically, when executing a pressing process, a plunger passes through the access space 143, of a size suitable for shaping the lower surface of the main body. The access space 143 is therefore of sufficient size to allow entry of this plunger, and is suitably arranged relative to the internal shape of the main body. Thus, if the plunger is moved along a path, the cross-sectional shape of the access space 143 normal to the path covers the shape defined by the inner face of the main body normal to said path. The largest dimension of this access space 143, in this cross-section, is greater than 3 centimeters or possibly greater than 5 cm, in particular greater than 7 cm, preferably greater than 10 cm.

This assembly interface 142 comprises an edge 104 of the container 101. The edge 104 forms a bead 105. It is understood here that the term "edge" is not used here to indicate, according to the usual meaning, a line or surface forming a rim, but a small volume relative to the volume of the container 101. The assembly interface 142 extends along an assembly axis X. In the example shown, the assembly axis is coincident with axis 102. The assembly interface 142 is integral with the peripheral wall 134 of the container 101. In the example shown, the assembly interface comprises an inner side surface 124 continuous with the inner face 138 of the peripheral wall 134 of the container 101. The inner faces 138 and 124 may even join together smoothly, with no shoulder or inflection. Alternatively, the inner side face 124 of the assembly interface 142 and the inner face 138 of the peripheral wall 134 are connected by a shoulder or some other dimensional pattern. The assembly interface 142 has an outer face 146 opposite the inner side surface 124. The outer face 146 connects to the outer face 140 of the peripheral wall 134. A rim 147 of the assembly interface 142 extends between the inner 124 and outer 146 side faces.

In practice, the assembly interface 142 is composed of an annular body 144 from which the bead 105 projects. The annular body forms a ring along the direction of assembly X. The annular body 144 is defined, on the radially internal side, by the inner side face 124 of the assembly interface 142. The annular body 144 is defined, on the radially external side, by a virtual geometric surface 164 parallel to the inner face 124 at a distance d therefrom which is constant for the entire periphery of the assembly interface.

In the example shown of a substantially rectangular shape, the annular body 144, in a given cross-sectional plane normal to direction X, presents a set of straight sections of thickness d, and rounded sections interconnecting the straight sections. The difference between the inner radius of curvature and the outer radius of curvature of the virtual geometric surface 164 is substantially d. The straight and rounded sections connect to each other tangentially.

Where appropriate, the virtual geometric surface 164 intercepts or has a common surface with the outer face 146 of the assembly interface 142.

In the example shown, the assembly interface 142 has a small height relative to its other two dimensions in the direction of assembly, and it can be considered to lie in a plane, which would be a midplane in the heightwise direction, which would be normal to the direction of assembly. When reference is made to the shape of the opening, this is generally referring either to the shape of the inner face 124 or to the virtual geometric shape 164 of the cross-section in this plane. Thus, when the opening is said to be substantially rectangular, this is in reference to the embodiment of FIG. 1 where the cross-section of the external shape of the virtual geometric surface 164 is substantially rectangular. It is therefore understood that the cross-section of the virtual geometric surface 164 of the edge 104 is substantially rectangular. Similarly, the cross-section of the inner face 124 is substantially rectangular. "Substantially" is used here to denote a rectangle with rounded edges, as in the main body 163.

When referring to the opening 103 having any polygonal shape or oval or circular shape, this again refers to the shape of the virtual geometric surface 164 in a cross-section orthogonal to the direction of assembly.

In general, the invention finds application in a circular shape of the opening 103, meaning the virtual geometric surface 164 in a cross-section normal to the direction of assembly, but more particularly to a non-circular shape. For a non-circular shape, the skilled person knows the level of regularity to expect in the case of a surface formed by a glass pressing process. A non-circular shape is considered to be such when a skilled person knows how to determine, when observing the shape, that it was intentionally made to be non-circular. Non-circular therefore does not cover circular shapes where surface defects from the manufacturing process depart the shape from the ideal geometric circle desired. The shape in question is that of the inner surface 124, and/or of the virtual geometric surface 164, regardless of protruding reliefs such as the bead 105.

The bead 105 may be continuous along the periphery of the container 101, as shown. In a plane normal to the direction of assembly, it may have a constant thickness, or a portion of constant thickness and portions having an increased thickness relative to the portion of constant thickness. In high curvature areas in particular, it may have such increased thickness.

Note that the shape of the outer face 146 is not necessarily of constant cross-section along an assembly axis. It may in particular be a shape from a homothetic transform along the assembly axis: in progressive cross-sections along the assembly axis, the edge 104 has a first tapered portion 148, which may coincide with the virtual geometric surface 164, then an enlarged portion 149 forming the bead 105. The edge 104 may be thinner than the peripheral wall 134. In particular, if the inner side surface 124 of the annular portion 144 lies in the continuity of the inner face 138 of the peripheral wall 134, the outer face 146 is located radially closer to the inner side surface 124 of the annular portion 144 than the outer face 140 is to the inner face 138. As a result, the tapered portion 148 forms a recess between the bead 105 and the peripheral wall 134. A shoulder 150 is provided at the junction between the peripheral wall 134 and the opening 103.

In the example, the edge 104 of the container 101 comprises a protruding element 106 (FIG. 2*a*), or bump, arranged substantially perpendicularly to an upper surface 107 of said edge. The bump 106 has small dimensions compared to the bead 105.

In summary, the container 101 has a main body 163 of any hollow shape, and an assembly interface 142 of a shape adapted to seal closed the packaging device. The assembly interface comprises in particular an annular body 144 from which a bead 105 projects. The annular body 144 forms a ring of constant thickness along the entire periphery of the container 101. In particular, the inner surface of this ring is a cylinder, particularly of non-circular cross-section. The cross-section is normal to the direction of assembly. The outer surface (virtual surface defined by the virtual geometric surface 164) of this ring is a cylinder, in particular of non-circular cross-section. The main body 163 and the annular body 144 are integrally formed, and join together in a technically suitable manner.

The opening of the container 101 is large. One will note, in the embodiment shown, that the annular body and the main body 163 may be of similar dimensions in a plane normal to the direction of assembly. By similar dimensions, it is understood that the inner surface of the annular body allows the passage of a rigid volume corresponding to a homothetic transformation at a ratio of between 75% and 120% of the volume defined by the inner surface of the main body 163. This characteristic will explained below.

According to one embodiment, the inner surface of the annular body allows the passage of a rigid volume corresponding to 100% of the volume defined by the inner surface of the main body. This characteristic should be understood as the volume defined by the inner surface of the main body substantially corresponding to the volume of the single-piece plunger passing through the annular body to form the inside of the container 101 during the pressing process. The inner surface of the annular body cannot be too large either, because the annular body is integral with the main body 163. Therefore, the inner surface of the annular body allows the passage of a rigid volume corresponding to no more than 120% (preferably 110%) of the volume defined by the inner surface of the main body. In the case of a single-piece plunger, a ratio of between 100% and 120% is provided.

However, the plunger is not necessarily a single piece, and may incorporate a mechanism movable between two positions for creating reliefs inside the main body 163. However, even in these cases, the fixed body of the plunger continues to be a substantial part of the internal volume. It is considered that in most cases, the fixed body of the plunger will be inscribed within a homothetic transformation at 90% of the volume defined by the inner surface of the main body. The ratio is therefore generally between 90% and 120% for a direct pressing process.

As mentioned above, the pressing step may be followed by a blowing step which will slightly enlarge the inside volume of the main body 163 without substantially changing that of the annular body. The main body 163 must also remain integral with the annular body. Therefore, the inside volume is not greatly expanded during this step. The inner surface of the annular body allows the passage of a rigid volume corresponding to a homothetic transformation at a ratio of between 75% (preferably at least 80%) and 100% of the volume defined by the inner surface of the main body 163.

The packaging device 100 further comprises a closure piece 108. The closure piece 108 has a base 109 (FIG. 2) of a shape substantially complementary to that of the opening 103, and in particular to that of the access space 143 of the container 101. Thus, in the example, the base 109 of the closure piece 108 is substantially rectangular in shape.

Figure 5:
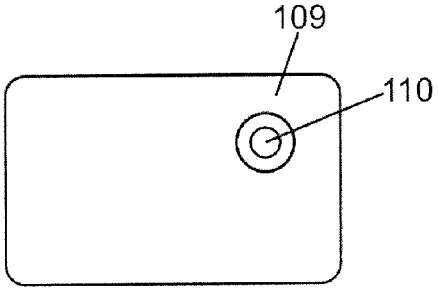
FIG. 5: a top view of an embodiment of a closure piece, FIG. 6; a view similar to FIG. 2*a* for an alternative embodiment of a closure piece.

The closure piece 108 has an opening 110 extending from the base 109 to an upper surface 111 of said closure piece. Here the term "opening" is used in its conventional sense, meaning an empty space allowing access through it. In the example, the opening 110 is substantially arranged along axis 102 of the container 101 during assembly of the packaging device 100. However, the opening 110 could also be offset relative to axis 102, as represented in FIG. 5. In FIG. 5, the opening 110 is offset relative to both the width and length of the rectangular shape of FIG. 1. The opening 110 is suitable for receiving a product dispensing device 112, such as a cap, stopper, or pump. In the example, the opening 110 receives a pump 112.

Figure 2:
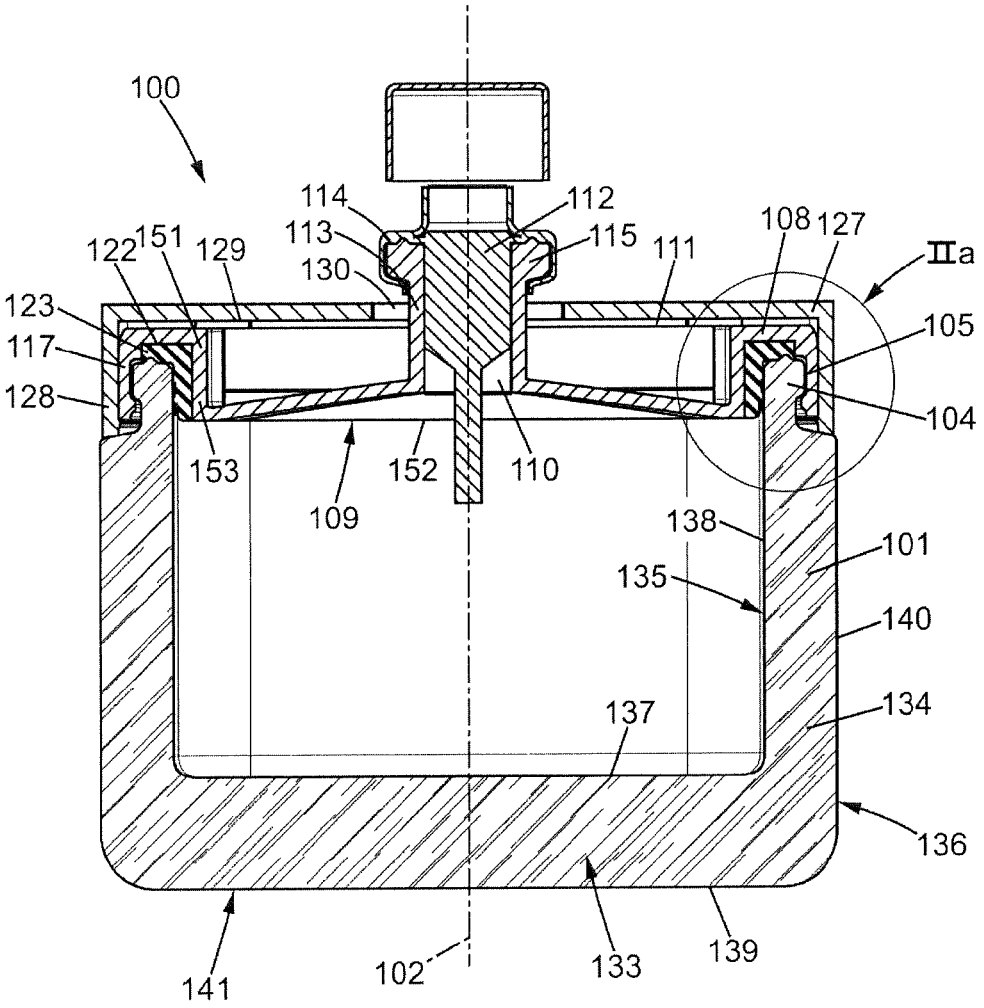
FIG. 2: a transverse cross-sectional view of the packaging device shown in FIG. 1, in an assembled state.

In the example, the opening 110 also extends through a cylindrical portion 113 of the closure piece 108 projecting from the upper surface 111 of said closure piece. An upper end 114 of the cylindrical portion 113 has a bead 115 onto which the pump 112 is crimped or clipped (FIG. 2). The dispensing device 112 can be assembled in any suitable manner to the closure piece 108.

In the example, the closure piece 108 comprises ribs 116 extending from the base 109 to the upper surface 111 of said closure piece. The ribs 116 radiate out from the opening 110 and are arranged substantially perpendicularly to the upper surface 111 of the closure piece 108. The ribs 116 stiffen the closure piece 108, so that the closure piece 108 is particularly suitable for withstanding the stresses induced by assembly of the product dispensing device 112 with the closure piece 108. They are, for example, arranged in a star around the cylindrical portion 113, as represented in FIG. 1.

The closure piece 108 also comprises side walls 117 made of an elastically deformable material, such as polypropylene, suitable for elastic interlocking as well as being chemically compatible with cosmetic products. A lower surface of the base 109 may be made of a material compatible with cosmetic products. The description refers here to side walls 117 as in the particular described embodiment having a substantially rectangular shape. However, given that the invention is equally applicable to other geometries including non-polygonal, it is understood that "walls 117" can be used interchangeably with "wall 117" if the geometry only has one wall. It is understood that the "side walls" together define the entire periphery of the closure piece 108 (this also applies to the "side wall" in non-polygonal configurations). The closure piece 108 may also be a single piece and therefore be made entirely of elastically deformable material. The closure piece 108 can thus deform slightly relative to its resting state to compensate for variations in the shape of the glass at the assembly interface 142. The side wall 117 extends from the upper surface 111. A groove 122 is provided between the side wall 117 and the base 109. The groove 122 has a shape substantially complementary to the shape of the edge 104 of the container 101. The base 109 may itself comprise a peripheral wall 151 extending from the lower face 152 opposite the upper face 111. The radially external face 153 of the peripheral wall 151 has a shape complementary to the inner side surface 124 of the annular portion 144. The side wall 117 includes a radially internal face 154 substantially complementary to the outer face 146 of the annular portion 144. The outer face 155 of the wall 117 is opposite to the radially internal face 154. The outer face 155 of the wall 117 is inscribed within the virtual cylindrical volume generated from the outer face 140 of the peripheral wall 134 of the container along the assembly axis.

The side walls 117 have a continuous free edge 118. The term "edge" is used here in its conventional meaning to indicate the rim of the side wall between its radially internal face 154 and its outer face 155. The term "continuous free edge" is understood to mean that the free edge 118 of the side walls 117 has no discontinuity in its material. The edge 118 is therefore free along the entire periphery of the side wall(s) 117. However, as a variant the edge 118 could be discontinuous.

In the example, an outer surface of an upper end 120 (FIG. 2*a*) of the side walls 117 of the closure piece 108 has a slightly conical profile, flaring out towards the free edge 118.

The side walls 117 of the closure piece 108 are provided with an internal relief 121 (FIG. 2*a*) forming a means of assembly by elastically interlocking around the bead 105 of the container 101. Preferably, the internal relief 121 is continuous along the entire periphery of the side walls 117 or, depending on the configuration as mentioned above, the side wall 117.

Figure 12A:
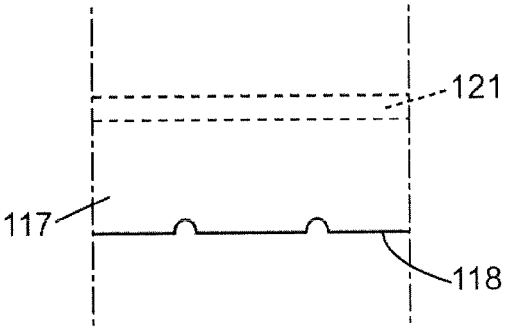
FIGS. 12*a* and 12*b*: side detail views of embodiments of the locking piece.
Figure 12B:
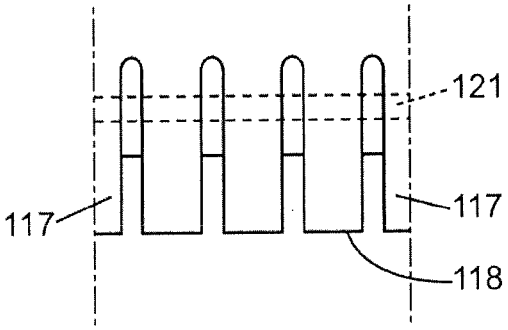

Thus, in different variants illustrated in particular in FIGS. 12*a* and 12*b*, the free edge 118 of the side wall 117 may have notches (or slits) possibly superimposed with the continuous relief 121.

The closure piece 108 further comprises the groove 122 (FIGS. 2 and 2*a*) formed in the base 109 of said closure piece. The groove 122 is defined by the base 109 on the one hand, and by the side walls 117 on the other. The groove 122 is of a shape substantially complementary to that of the edge 104 of the container 101, so as to accept therein the edge 104 of said container. The groove 122 is therefore substantially rectangular in shape. Substantially rectangular in shape is understood to mean that in a cross-section along a plane normal to the assembly axis, the groove 122 has an annular shape corresponding to the annular shape of the edge 104 in the same plane. This annular shape has inner and outer surfaces in the form of a rectangle with rounded corners.

In the example, the closure piece 108 comprises a gasket 123 (FIGS. 2 and 2*a*) able to form a sealing connection between the edge 104 of the container 101 and the closure piece 108. The gasket 123 is preferably formed of a more compressible material than the closure piece 108. Alternatively, the gasket 123 is formed of an incompressible deformable material. The gasket 123 consists, for example, of an elastomer such as rubber, a thermoplastic elastomer, or a cellular material such as a polyurethane or polyethylene foam, particularly a high density foam.

The gasket 123 is of a shape substantially complementary to the edge 104 of the container 101. The gasket 123 thus substantially forms a rectangle. The shape of the gasket is annular having a substantially constant cross section along the peripheral direction of the ring, and the generator of the periphery is approximately rectangular in shape.

The groove 122 of the closure piece 108 is adapted to receive the gasket 123. A cross-section of the gasket 123 is of a shape substantially complementary to that of a profile of the groove 122, so that the gasket 123 mates with the walls of the groove 122. In particular, a shoulder 157 is provided in the groove 122 to form a radial abutment surface for the gasket 123.

Figure 2A:
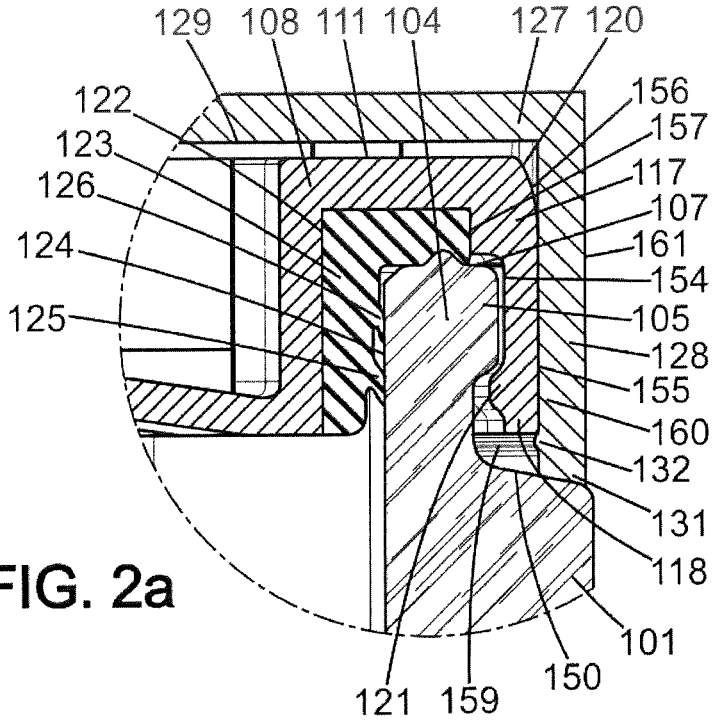
FIG. 2*a*: a detail view of FIG. 2.
Figure 2B:
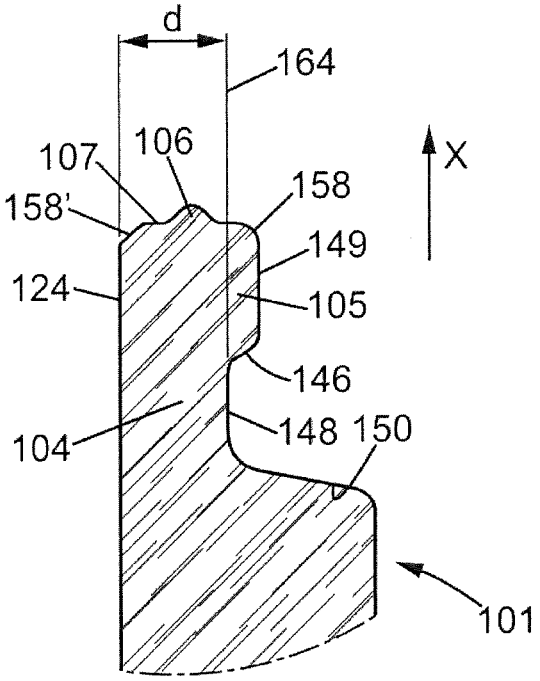
FIG. 2*b*: a detail view of the container of FIG. 2.

According to one embodiment of the invention, the gasket 123 is configured to form a sealing connection between the closure piece 108 and a surface of the edge 104 of the container 101, said surface being chosen from among the bead 105, the upper surface 107, and an inner side surface 124 (FIG. 2*a*).

In this case, the gasket 123 may, for example, take the form of a band.

According to a preferred embodiment of the invention, the gasket 123 is configured to form a sealing connection between the closure piece 108 and at least two surfaces of the edge 104 of the container 101 which are chosen from among the bead 105, the upper surface 107, and the inner side surface 124.

In the example, the gasket 123 has a substantially L-shaped cross-section so as to match against the upper surface 107 and the inner side surface 124 of the edge 104 of the container 101. Such a cross-section may also be applicable in the case where the gasket 123 is to mate with the upper surface 107 and the bead 105 of the edge 104 of the container 101.

The gasket 123 may also have a substantially triangular cross-section so that one face of said gasket is compressed against a corner 158, 158' of the edge 104 of the container 101, said corner being respectively formed between the upper surface 107 and the inner side surface 124 or the bead 105.

A gasket 123 of substantially U-shaped cross-section would also be possible, to mate with the upper surface 107, the inner side surface 124, and the bead 105.

According to one embodiment of the invention, the gasket 123 comprises at least one protruding element 125, 126 or sealing lip adapted to form a sealing line against the edge 104 of the container 101. Preferably, the at least one sealing lip 125, 126 is of tapered shape.

In the example, the gasket 123 has two sealing lips 125, 126 (FIG. 2*a*), each adapted to form a sealing line against the inner side surface 124 of the edge 104 of the container 101.

A larger number than two sealing lips may also be considered, particularly when the gasket 123 is configured to form a sealing connection between the closure piece 108 and only one of the surfaces 105, 107, or 124 of the edge 104 of the container 101.

When at least two sealing lips 125, 126 are used, they may also, depending on the configuration of the gasket 123, be arranged so that each forms a sealing line against several surfaces 105, 107, 124 forming the edge 104 of the container 101.

Figure 6:
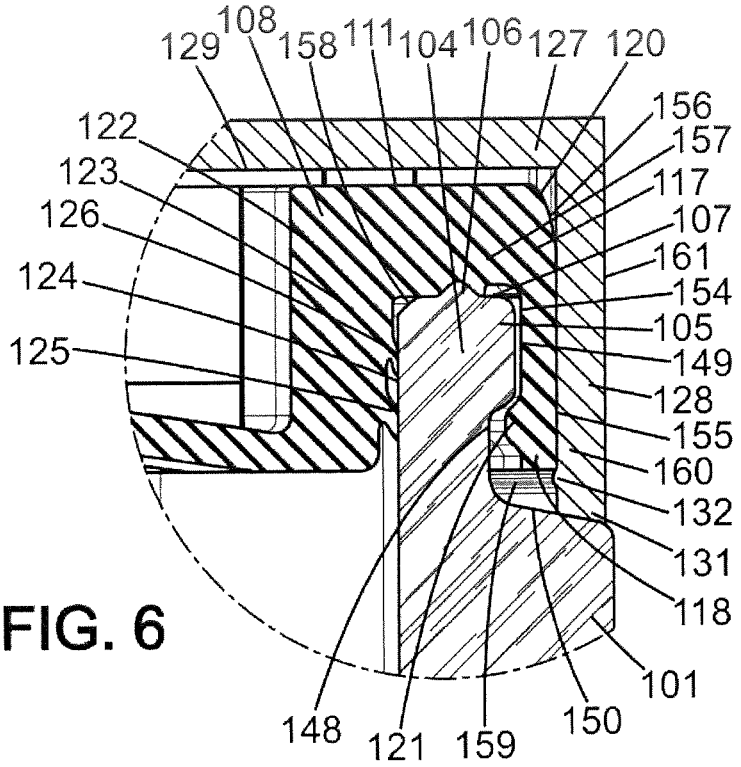

According to a variant represented in FIG. 6, the closure piece 108 and the gasket 123 are integral and formed of the same material. This applies particularly in the case of polyethylene or high density polyethylene. The characteristics of the gasket 123 as well as the embodiments detailed above can be adapted to a closure piece 108 alone. For example, the closure piece 108 can form a sealing connection with one, two, or three surfaces 105, 107, 124 of the edge 104 of the container 101. The closure piece 108 may also comprise one or more protruding elements 125, 126 each adapted to form a sealing line against the edge 104 of the container 101.

In a variant, the closure piece has a face suitable for being compressed against a corner of the edge 104 of the container 101, said corner being formed between an upper surface 107 and an inner side surface 124 or the bead 105.

The packaging device 100 further comprises a locking piece 127 adapted for fitting around the side walls 117 of the closure piece 108. It is understood here that the closure piece 108 is suitable for insertion into the locking piece 127, with the locking piece 127 fitting around the side wall(s) of the closure piece 108. In the example, the slightly tapered profile of the outer surface 156 of the upper end 120 of the side walls 117 of the closure piece 108 is intended to facilitate assembly of the locking piece 127 with the closure piece 108.

The locking piece 127 is made of a material that allows little elastic deformation compared to the material of the closure piece 108. Such material may, for example, be rigid plastic or metal, or stiffened by a surface treatment such as galvanizing or lacquering.

The locking piece 127 has side walls 128 adapted to surround the side walls 117 of the closure piece 108. This example is still for the exemplary embodiment having a substantially rectangular geometry. It is thus understood that in other embodiments, the locking piece 127 has at least one side wall 128 adapted to surround the side wall 117 of the closure piece 108. The following description continues to refer to the specific geometry of the embodiment shown, but can be adapted to any other embodiment. The side walls 128 of the locking piece 127 are configured so as to form a tight connection with the closure piece 108, in particular with the one or more side walls 117 thereof, when the side walls 128 of said locking piece are fitted around the side walls 117 of the closure piece 108.

The locking piece 127 may comprise a base 129, and the side walls 128 extend from the base.

The side walls 128 of the locking piece 127 are substantially parallel to the side walls 117 of the closure piece 108. In the example, the side walls 128 of the locking piece 127 are substantially parallel to a lower end of the side walls 117 of the closure piece 108. Thus, the fitting of the side walls 128 of the locking piece 127 around the side walls 117 of the closure piece 108 lock the closure piece 108 around the bead 105 of the container 101 without causing elastic deformation of said side walls 117 of the closure piece 108.

In the example, the locking piece 127 also comprises a base 129 (FIGS. 2 and 2*a*) provided with an opening 130 adapted to receive the dispensing member such as the pump 112. In practice, in the example shown, the opening 130 receives the cylindrical portion 113 to which the dispensing member is attached. The opening 130 thus forms an opening for accessing the product contained within the packaging device. The opening 130 of the locking piece 127 is configured to be substantially coaxial with the opening 110 of the closure piece 108, during assembly of the packaging device 100. The dispensing member can then extend through both the locking piece 127 and the closure piece 108 to allow communication between the interior of the packaging device and the outside.

In the example, axial retention of the locking piece 127 is provided on the closure piece 108. For example, the locking piece 127 clips onto the closure piece 108. For example, a free edge 131 of the side walls 128 of the locking piece 127 is provided with an internal relief 132 (FIG. 2*a*). The dimensions of the internal relief 132 of the locking piece 127 are small compared to the internal relief 121 of the closure piece 108. The internal relief 132 of the locking piece 127 is adapted to abut against the free edge 118 of the closure piece 108. In the example shown, one will note that when the closure piece 108 is mounted on the container 101, a gap 159 is defined for this purpose between the free edge 118 of the side wall 117 of the closure piece 108 and the shoulder 150 of the container 101. The internal relief 132 is received in this gap 159 when the locking piece 127 is assembled with the closure piece 108.

The side wall 128 of the locking piece 127 has an inner face and an opposing outer face 161. The free edge 131 of the side wall 128 connects the inner 160 and outer 161 faces. The inner face 160 has a geometry complementary to that of the outer face 155 of the side wall 117 of the closure piece 108. The outer face 161 has any suitable shape. Note that in the embodiment shown, the free edge 131 comes into intimate contact with the shoulder 150 of the container 101. This can be verified along the entire periphery of the container 101. Intimate contact is understood to mean that these two surfaces come into close contact, or are spaced apart at an insignificant distance at the scale of the product (specifically such that a tool having the thickness of a knife blade or similar cannot be slid between these surfaces). Moreover, and completely independently in this embodiment, outer face 161 is continuous with outer face 140 of the container 101. This continuity can, as shown, be provided with no shoulder or inflection.

The packaging device therefore comprises a glass container that is very rigid but whose shape has a certain variability, a flexible closure piece able to deform elastically to compensate for variabilities of the glass container, and a rigid locking piece (its stiffness between those of the glass and the closure piece) for holding together the flexible closure piece and the glass container. Where appropriate, a highly deformable gasket further improves the interface between the glass and the flexible closure piece.

The method for assembling such a packaging device 100 has the following steps.

In the example, the gasket 123 is first applied against the base 109 of the closure piece 108. Specifically, the gasket 123 is placed in the groove 122 formed in the base 109 of the closure piece 108. According to one embodiment of the invention, the gasket 123 may be cut or molded and then applied against the base 109 of the closure piece 108, or may be overmolded onto the closure piece 108.

The closure piece 108 is then mounted on the container 101 by elastically interlocking the side walls 117 around the bead 105 by moving the bead in translation 105 towards the base 109 of the closure piece 108. The container 101 and closure piece 108 are moved relative to each other in a direction of assembly. In the example, this direction of assembly is a direction of translation. For example, it is coincident with axis 102. The continuous free edge 118 of the side walls 117 of the closure piece 108, and in particular the continuous relief 121, causes said side walls to deform radially when the internal relief 121 passes over the bead 105, then to return to a non-deformed or slightly deformed state when the internal relief 121 catches under the bead 105. The internal relief 121 of the closure piece 108 is then abutting against the bead 105, preventing detachment of the closure piece 108 from the container 101. The side walls 117 of the closure piece 108 are elastically interlocked around the bead 105 prior to fitting the locking piece 127 around the side walls 117. This embodiment has the advantage that the side wall 117, once the packaging device is assembled, is substantially in the rest state, and in any case the natural elasticity of the materials of the side wall 117 biases the side wall 117 toward a state where it is interlocked onto the container and mechanically cooperates with it.

The elastic interlocking of the side walls 117 around the bead 105 forms a sealing contact between the gasket 123 and the edge 104 of the container 101, and between the gasket 123 and the closure piece 108, by compression of said gasket. In the example, the sealing contact between the gasket 123 and the edge 104 is achieved in particular at the upper surface 107 of the edge 104, particularly with the protruding bump 106 on the edge 104, and at the inner side surface 124, particularly by means of the sealing lips 125, 126 which each form a seal line.

In this configuration, the compression of the gasket 123 between the edge 104 of the container 101 and the closure piece 108 transmits to the closure piece 108 a force along axis 102 which tends to detach the side walls 117 of the closure piece 108 from the bead 105 of the container 101.

According to a variant, shown in FIG. 6, where the closure piece 108 and the gasket 123 are integral and formed of the same material, the elastic interlocking of the side walls 117 around the bead 105 forms a sealing contact between the closure piece 108 and the edge 104 of the container 101, by compression of said closure piece. The edge 104 of the container 101 transmits to the compressed closure piece 108 a force along axis 102 which tends to detach the side walls 117 of the closure piece 108 from the bead 105 of the container 101.

Next, the locking piece 127 is force-fitted around the side walls 117 of the closure piece 108. This force-fitting is achieved via a relative movement in translation, along the direction of assembly, of the locking piece 127 and of the assembled container 101 and closure piece 108 assembly. The slightly tapered profile 156 of the upper end 120 of the side walls 117 of the closure piece 108 assist with fitting the side walls 128 of the locking piece 127 around said side walls of the closure piece 108. The side walls 128 of the locking piece 127 slide along the side walls 117 of the closure piece 108 without causing appreciable elastic deformation of said side walls of the closure piece 108. The side walls 128 of the locking piece 127 retain the side walls 117 of the closure piece 108 around the bead 105 of the container 101, preventing the side walls 117 of the closure piece 108 from detaching from the bead 105. The locking piece 127 thus counteracts the axial force transmitted to the closure piece 108 by the compression of the gasket 123. Assembly of the packaging device is intended to be permanent, meaning that neither the closure piece nor the locking piece are designed for removal from the container during normal use of the packaging device.

In the example, the container 101 is then filled with a cosmetic product. Next, a dispensing member such as pump 112 is inserted into the openings (110, 130) of the closure piece 108 and locking piece 127, then secured, for example by crimping, screwing, or snap-fitting around the bead 115 of the cylindrical portion 113 of said closure piece. One will note in particular that here the dispensing member is assembled to the closure piece 108, with the cylindrical portion 113 of the closure piece 108 forming an attachment tube extending through the opening 130 of the locking piece 127. As a variant, the dispensing member may be assembled to the locking piece 127. The dispensing member is connected to the closure piece 108 in a manner that forms a seal. Access to the product inside the packaging device is only possible via the dispensing member. The locking piece 127 is designed to be resistant to removal once assembled onto the container 101. This resistance to removal is only relative to means directly accessible to a user of the packaging device, such as a bottle opener or a knife blade. Although the resistance to removal is particularly possible due to the absence of unevenness at the interface between the free edge 131 of the locking piece 127 and the shoulder 150, such an absence of unevenness is not absolutely necessary to implementation of the invention. This absence of unevenness also eliminates the accumulation of unhealthy materials (dust, etc.) at this location.

Where appropriate, the locking piece 127 may be bonded to the closure piece 108, or to the container 101, for example by gluing at the free edge 131.

Alternatively, the elastic interlocking of the side wall 117 of the closure piece around the bead is achieved by force-fitting the locking piece 127 around the side wall 117 of the closure piece. In this example, the closure piece is assembled to the container 101 with a gap between the relief 121 and the bead 105. The locking piece then deforms the side wall 117 to cause the elastic interlocking of the side wall 117 of the closure piece around the bead.

Such a method for assembling a packaging device 100 has the advantage of not being limited to packaging devices 100 where the glass container 101 comprises a circular opening 103. The method described above allows a wide variety of shapes for the glass container 101, and therefore a wide variety of shapes for the packaging device 100 in general. In particular, it is suitable for containers 101 where the inner surface and/or virtual geometric surface 164 of the annular portion 144 has a shape that is not a right-circular cylinder. Indeed, for such geometries, a fluidtight seal is very difficult to guarantee due to the peripheral non-uniformity of the forces applied to the gasket. This is especially true when the dimensions of the areas where a seal is to be obtained are large, as in the present case where the opening 103 of the container has about the same size as the dimensions of the container 101. Tests have shown that the invention allows excellent sealing while providing easy assembly.

The above embodiment details the case where the main body 163 of the container 101 has a substantially rectangular shape, and where the assembly interface 142 has a substantially rectangular shape. There are many variants. In particular, these shapes are not necessarily closely correlated. These shapes may even be substantially independent of one another. For the main body 163, its external shape is substantially independent of its internal shape. For the assembly interface, its internal and external shapes may be strongly dependent on each other. In particular, a constant thickness of the material along the periphery of the assembly interface 142 is provided. As a variant, the thickness of the material provided along the periphery of the assembly interface 142 is dependent on the local curvature. In particular, a gradual transition is provided between two portions that are angled relative to one another (in particular, note in FIG. 1 a curvature of the rounded edge of the assembly interface that is much smaller than that of the main body 163).

The embodiment detailed above presents the case where the outer face 155 of the wall 117 is inscribed within the virtual cylindrical volume generated by the outer face 140 of the peripheral wall 134 of the container along the axis of assembly, and where the outer face 161 of the side wall 128 is coincident therewith, thereby improving the resistance of the packaging device to user access to its interior. However, as a variant, the outer face 161 of side wall 128, or possibly the outer face 155 of side wall 117, may extend beyond the virtual cylindrical volume generated by the outer face 140 of the peripheral wall 134 of the container along the axis of assembly.

Figure 7:
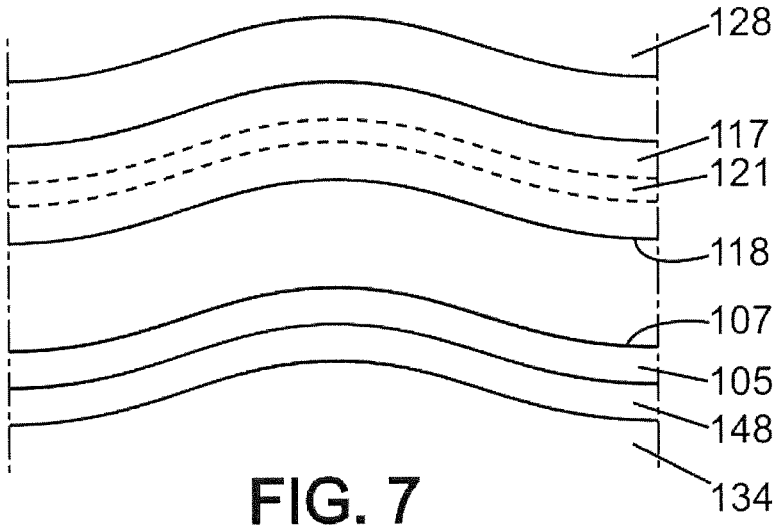
FIG. 7: a partial side view for an alternative geometry.

According to a variant represented in FIG. 7, the opening of the container may not be planar, for example it may be curved. In this case, in a given cross-section comprising the axis of assembly, the same principles apply as described above. However, the geometry can vary depending on the cross-sectional plane chosen along the periphery of the container.

Figure 8:
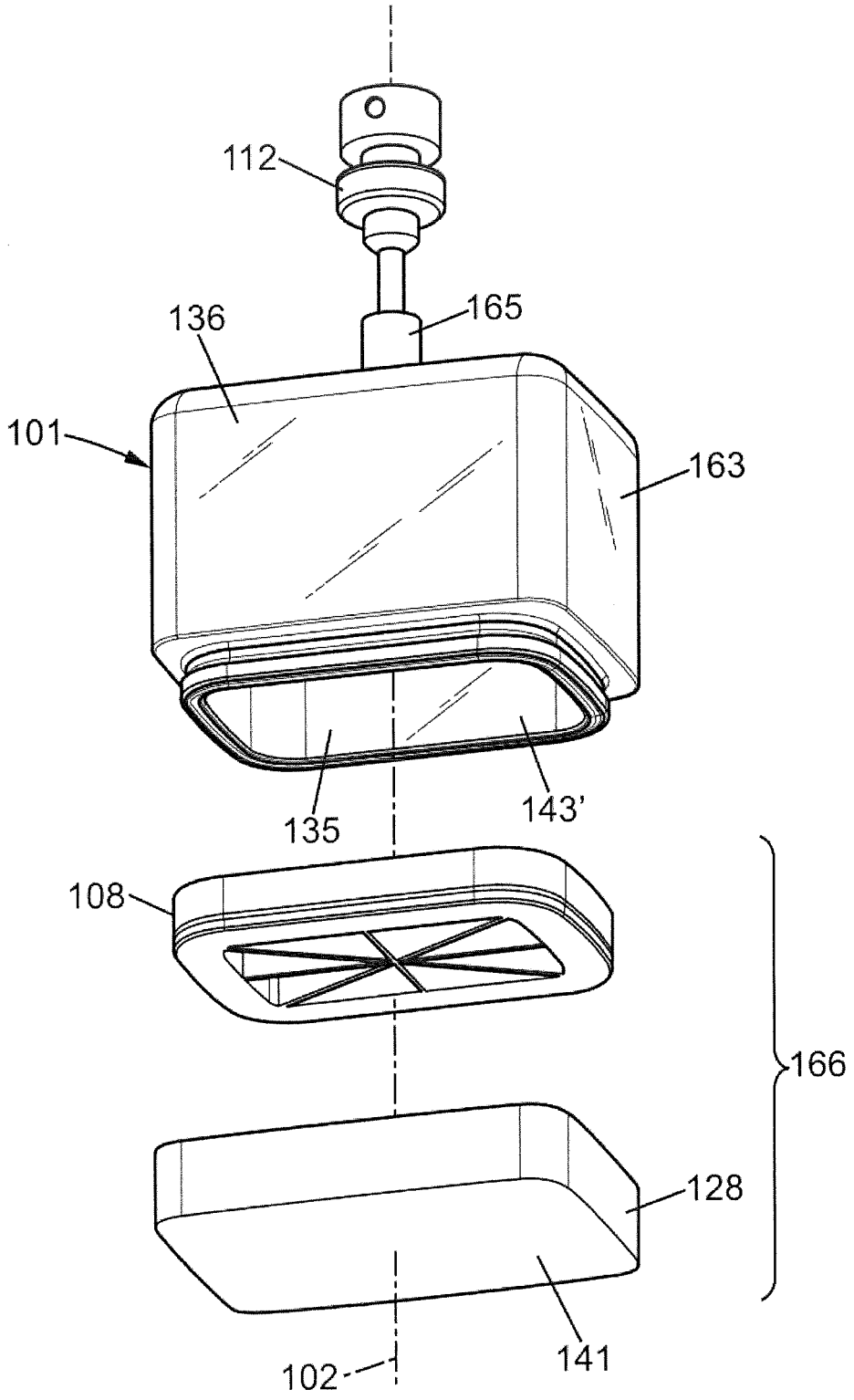
FIG. 8: a variant implementation of the packaging device.

According to another variant, as represented in FIG. 8, the closure piece can form a base of the container and not a cover as shown in the example represented in the above figures and description. A base is characterized in that, when the container 101 is placed on its support surface 141, the contents of the container 101 rest on the base.

In such an embodiment, the locking piece 127 and the closure piece 108 may not have their respective openings 130, 110. In this case, portion 129 (previously referred to as the "base") of the locking piece 127 can be solid.

Figure 11:
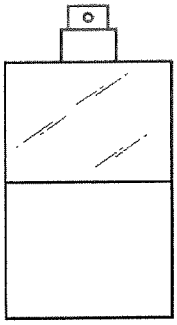
FIGS. 10 and 11: a variant implementation (respectively a detail view and a schematic view)
Figure 10:
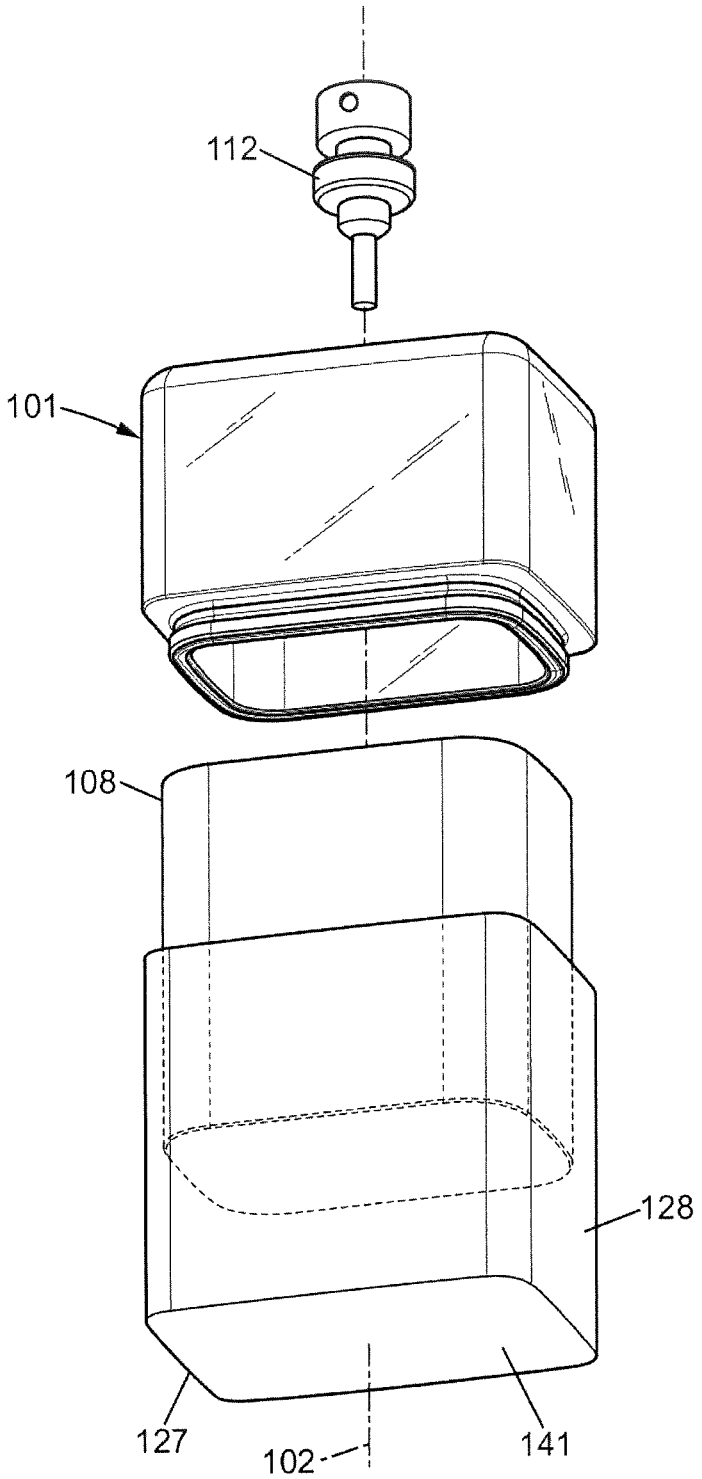

This variant can also be implemented in another embodiment, illustrated in FIGS. 10 and 11, where the locking piece 127 has been slightly modified to extend further. In the embodiment of FIG. 10, the locking piece 127 is not only a locking piece but also comprises a container portion. The container has a hollow shape which is capable of holding a liquid.

To summarize, for this embodiment the container is manufactured as follows:

A hollow body 101 is manufactured of glass for packaging devices, the hollow body 101 being intended to be associated with a base 166 to form the packaging device, the hollow body 101 comprising an open lower end 143' providing access to a hollow interior, an upper end forming a bottle neck 165 adapted for mounting a dispensing device 112 such as a stopper or a pump, and a hollow main section connecting the two ends, this section defining an inner surface 135 and an outer surface 136, the method comprising the molding of the hollow body 101 in a mold comprising one or more impressions to form the outer surface 136 and the bottle neck 165, from the molten glass introduced into the impressions.

During the process, a shaping plunger is lowered into the mold impression(s) to press the molten glass into a molding/pressing cavity jointly formed by the mold impression(s) and the shaping plunger, the shaping plunger penetrating into the mold impression(s) through an opening which corresponds to the open lower open 143' of the hollow body 101. The internal shape of the container can thus be controlled with high precision.

The base 166 comprises the closure piece 108 and the locking piece 127. The base 166 is attached to the lower end of the hollow body 101 by the method described above. In particular, the closure piece is mounted on the glass container by elastically interlocking the at least one side wall of the closure piece around the bead by moving the container relative to the closure piece in a direction of assembly, said elastic interlocking ensuring a sealing contact between the closure piece and the container. The locking piece is then fitted around the side wall of the closure piece.

In this case, note that the interior of the bottle neck can either be shaped by the shaping die, or by machining, boring, or drilling, and then polishing, an enclosed pressed surface.

Figure 9:
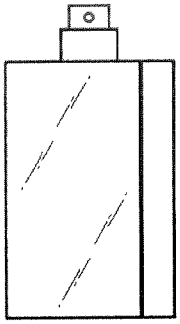
FIG. 9: a schematic view of a variant implementation.

The closure piece 108 (and implicitly the locking piece 127 assembled to it) may also form a side of the container, as shown in FIG. 9. Depending on the embodiment chosen, the opening providing access to the product may be created in the closure piece (and implicitly in the locking piece 127 assembled to it, for example FIG. 1) or in the glass container 101 (for example FIG. 8, FIG. 9).

According to one embodiment, the invention relates to a method for assembling a device for packaging a cosmetic product, said device comprising:

- a glass container 101, said container having an opening 103, an edge 104 of said opening forming a bead 105;
- a closure piece 108 having a base 109 of a shape substantially complementary to that of the opening of the container, the closure piece further having side walls 117 made of an elastically deformable material, and of which a free edge 118 is continuous, said walls being provided with an internal relief 121, said relief forming a means of assembly by elastically interlocking around the bead;

- a locking piece 127, adapted to be fitted around the side walls of the closure piece, said locking piece being made of a material that allows little elastic deformation;

the method comprising the steps of:

- the closure piece is mounted on the glass container by elastically interlocking the side walls around the bead by moving the bead in translation towards the base of the closure piece, said elastic interlocking ensuring a sealing contact between the closure piece and the edge of container;
- the locking piece is force-fitted around the side walls of the closure piece.

The invention claimed is:

1. The method for assembling a device for packaging a cosmetic product, said method comprising:

- providing a container of pressed glass, said container having an opening, an edge of said opening forming a bead;
- providing a closure piece having at least one side wall made of an elastically deformable material,
- said at least one side wall being provided with an internal relief, said relief forming a means of assembly by elastically interlocking around the bead;
- providing a locking piece, adapted to be fitted around said at least one side wall of the closure piece, said locking piece comprising at least one side wall made of a material that allows little elastic deformation compared to said elastically deformable material;
- moving the container relative to the closure piece in a direction of assembly until the closure piece is mounted on the glass container by elastically interlocking the at least one side wall of the closure piece around the bead, said elastic interlocking ensuring a sealing contact between the closure piece and the container;
- fitting the locking piece around said at least one side wall of the closure piece, thereby providing a permanent assembly of the locking piece to the container,
- wherein the closure piece or the glass container has an opening providing access to the product of the packaging device.

2. The method according to claim 1, wherein the closure piece further comprises a base, a compressible or deformable gasket applied against the base of the closure piece prior to assembly of the closure piece and glass container, the elastic interlocking of said at least one side wall of the closure piece around the bead ensuring a sealing contact between the gasket and the edge of the container, and between the gasket and the closure piece.

3. The method according to claim 1, wherein the locking piece is force-fitted in the direction of assembly.

4. The method according to claim 1, wherein the edge comprises an annular body from which the bead projects, the annular body having an inner surface and an outer surface parallel to the inner surface, one and/or the other of these surfaces having a non-circular cross-section transversely to the direction of assembly.

5. The method according claim 1, wherein the container comprises an annular body from which the bead projects and a main body, and wherein an inner surface of the annular body allows the passage of a rigid volume corresponding to a homothetic transformation at a ratio of between 75% and 120% of the volume defined by an inner surface of the main body.

6. The method according to claim 1, further comprising one or more of the following characteristics:

- the internal relief is continuous along the entire periphery of the at least one side wall, the locking piece is fitted around said at least one side wall of the closure piece by force-fitting the locking piece around said at least one side wall of the closure piece, the closure piece has a base of a shape substantially complementary to that of the opening of the container;

the closure piece has a base and the closure piece is mounted on the glass container by moving the bead in translation towards the base of the closure piece;

the closure piece comprises at least one side wall having a free edge that is continuous;

the closure piece comprises side walls having a free edge that is continuous, the side walls being provided with the internal relief, and the internal relief is continuous along the entire periphery of the side walls, the locking piece being force-fitted around the side walls of the closure piece;

the closure piece comprises side walls of which a free edge is continuous, the side walls being provided with the internal relief, the internal relief is continuous along the entire periphery of the side walls, the closure piece is mounted on the glass container by elastically interlocking the side walls around the bead, and optionally said elastic interlocking ensures a sealing contact between the closure piece and the edge of the container;

the locking piece is made of a material that allows little elastic deformation compared to said elastically deformable material.

7. A device for packaging a cosmetic product, comprising:

a container of pressed glass, said container having an opening, an edge of said opening forming a bead;

a closure piece having at least one side wall made of an elastically deformable material, said at least one side wall being provided with an internal relief, natural elasticity of said elastically deformable material biasing the side wall toward a state where said relief forming a means of assembly by elastically interlocking around the bead, said elastic interlocking ensuring a sealing contact between the closure piece and the container;

a locking piece, fitted around said at least one side wall of the closure piece, permanently assembled to the container, said locking piece having at least one side wall made of a material that allows little elastic deformation compared to said elastically deformable material;

the closure piece and the glass container having an opening providing access to the product of the packaging device.

8. A packaging device according to claim 7, wherein the edge comprises an annular body from which the bead projects, the annular body having an inner surface and an outer surface parallel to the inner surface, one and/or the other these surfaces having a non-circular cross-section transversely to the direction of assembly.

9. A packaging device according to claim 7, wherein the inner surface of the annular body allows the passage of a rigid volume corresponding to a homothetic transformation at a ratio of between 75% and 120% of the volume defined by the inner surface of the main body.

10. A packaging device according to claim 7, wherein the closure piece is adapted to form a sealing connection with at least two surfaces of the edge of the container, these surfaces being selected from among an inner side surface, an upper surface, and the bead.

11. A packaging device according to claim 7, wherein the closure piece has a face suitable for being compressed against a corner of the edge of the container, said corner being formed between an upper surface and an inner side surface or the bead.

12. A packaging device according to claim 7, wherein the closure piece comprises at least one protruding element suitable for forming a sealing line against the edge of the container.

13. A packaging device according to claim 7, wherein the closure piece comprises a compressible or deformable gasket suitable for forming a sealing connection between the edge of the container and the closure piece.

14. A packaging device according to claim 13, wherein the gasket is suitable for forming a sealed connection between the closure piece and at least two surfaces of the edge of the container, these surfaces being selected from among an inner side surface, an upper surface, and the bead.

15. A packaging device according to claim 13, wherein the gasket has a face suitable for being compressed against a corner of the edge of the container, formed between an upper surface and an inner side surface or the bead.

16. A packaging device according to claim 13, wherein the gasket comprises at least one protruding element suitable for forming a sealing line against the edge of the container.

17. A packaging device according to claim 7, wherein the bead is continuous along the entire periphery of the edge.

18. A packaging device according to claim 7, wherein the opening has a cylindrical shape which is not of right-circular geometry.

19. A packaging device according to claim 7, wherein the closure piece comprises the opening providing access to the product.

20. A packaging device according to claim 19, wherein the locking piece comprises an opening communicating with the opening of the closure piece.

21. A packaging device according to claim 7, wherein the container comprises the opening providing access to the product.

22. A packaging device according to claim 7, wherein the locking piece comprises a free edge in intimate contact with the container.

23. The device according to claim 7, further comprising one or more of the following characteristics:

the internal relief is continuous along the entire periphery of the at least one side wall, the locking piece is force-fitted around said at least one side wall of the closure piece, the closure piece has a base of a shape substantially complementary to that of the opening of the container;

the closure piece has a base and the closure piece is mounted on the glass container by moving the bead in translation towards the base of the closure piece;

the closure piece comprises at least one side wall having a free edge that is continuous;

the closure piece comprises side walls of which a free edge is continuous, the side walls being provided with the internal relief, and the internal relief is continuous along the entire periphery of the side walls, the locking piece being force-fitted around the side walls of the closure piece;

the closure piece comprises side walls of which a free edge is continuous, the side walls being provided with the internal relief, the internal relief is continuous along the entire periphery of the side walls, the closure piece is mounted on the glass container by elastically interlocking the side walls around the bead, and optionally said elastic interlocking ensures a sealing contact between the closure piece and the edge of the container;

the locking piece is made of a material that allows little elastic deformation compared to said elastically deformable material.

* * * * *